US006425834B1

(12) United States Patent
Nozato

(10) Patent No.: US 6,425,834 B1
(45) Date of Patent: Jul. 30, 2002

(54) FLYING BALL STOPPING NET FOR BALL GAMES

(75) Inventor: Kazu Nozato, Osaka (JP)

(73) Assignee: Toa Sports Machine Incorporated, Osaka (JP)

( * ) Notice: Subject to any disclaimer, the term of this patent is extended or adjusted under 35 U.S.C. 154(b) by 0 days.

(21) Appl. No.: 09/659,827

(22) Filed: Sep. 11, 2000

(30) Foreign Application Priority Data

Sep. 14, 1999 (JP) ..... 11-261290

(51) Int. Cl.[7] ..... A63B 67/00; A63B 69/00; A63B 63/00; A63B 71/00

(52) U.S. Cl. ..... 473/421; 473/446; 473/471; 473/478

(58) Field of Search ..... 473/421, 446, 473/471, 478, 197, 482, 492, 494; 403/57, 71, 111, 113, 109.6, 109.4, 110, 118, 119, 120, 129, 132, 144, 166, 147; 267/53, 160; 70/143, 165, 205

(56) References Cited

U.S. PATENT DOCUMENTS 3,013,801 A * 12/1961 Kirkconnell, Jr. ..... 473/421
3,076,532 A * 2/1963 Frye ..... 473/492
3,328,928 A * 7/1967 Frye ..... 473/492
4,407,505 A * 10/1983 Kendziorski ..... 473/173
4,913,439 A * 4/1990 Ellington ..... 473/197
5,851,081 A * 12/1998 Rude ..... 403/113
6,168,540 B1 * 1/2001 McKenna ..... 473/426

* cited by examiner

*Primary Examiner*—Paul T. Sewell
*Assistant Examiner*—Alvin A. Hunter, Jr.
(74) *Attorney, Agent, or Firm*—Rader, Fishman & Grauer

(57) ABSTRACT

A flying ball stopping net device having a plurality of legs arranged side by side one ht ground. The legs extend in one direction substantially horizontal with a frame extending upward away from the legs. The frame has supports that support lower portions of the frame body at longitudinally intermediate portions of the legs. A net surrounds the outer edge of the frame body to which it is attached. Each support includes a first support pipe projecting upward from the longitudinal intermediate portion of the leg. A second support pipe projects downwardly from the lower portion of the frame body and is removably fitted to the first support pipe for relative turning movement around the axis thereof. An elastic locking body having one end fitted in one of the first and second support pipes and is locked therein. The other end of the elastic body is removably fitted in the other one of the first and second support pipes to be pressed against the inner peripheral surface thereof. The inner peripheral surface of the other support pipe and the other end of the locking body are relatively slidable around the axis of the other support pipe.

1 Claim, 5 Drawing Sheets

FLYING BALL STOPPING NET FOR BALL GAMES

FIELD OF THE INVENTION

The present invention relates to a flying ball stopping net device for ball games, which, when a ball game, such as baseball in the field, is played or practiced, is used to prevent a flying ball from flying farther than is necessary or accidentally flying toward a player.

BACKGROUND OF THE INVENTION

As for the aforesaid flying ball stopping net device for ball games, there has been one disclosed in Japanese Patent laid open Publication NO. 9-266969.

According to the above publication, the flying ball stopping net device for ball games comprises a plurality of legs arranged side by side on the ground and respectively extending in one direction that is substantially horizontal, a frame body extending above said legs and substantially orthogonally to said one direction and along a substantially vertically extending imaginary plane, supports for supporting the lower portion of said frame body at longitudinally intermediate portions of said legs, and a flying ball stopping net closing the space surrounded with the outer edge of said frame body and attached to the latter. The legs and supports enable said frame body together with the flying ball stopping net to stand by itself on the ground and in this case said net device is in the "usable state."

Said supports are clamps, and clamping and unclamping operations applied to said clamps make the frame body removably mountable on said legs.

In this connection, in the prior art described above, since the ends of the legs project from the frame body in said one direction, the outer shape of said net device is large as a whole. As a result, when said net device is passed through a narrow place, such as the doorway of a gymnasium, in moving it from its "usable state" for the purpose of, for example, storage, there is the danger of the ends of said legs interfering with passage.

Thus, during said operation of moving the net device, the practice has been to apply an unclamping operation to said clamps, to separate said legs and the frame body from each other, to disassemble said net device, and to bundle the parts, thereby reducing the outer shape of the net device to establish the "disassembled state."

On the other hand, when it is desired to bring said net device form the "disassembled state" into the "usable state," the practice has been to apply a claming operation to said clamps to thereby fix the frame body to said legs.

However, since the unclamping operation and the clamping operation applied to said clamps are troublesome, the operation of bringing the net device from either the "disassembled state" or the "usable state" into the other state is very troublesome. Further, the operation of moving the net device to a desired position as by passing it through a narrow place is very troublesome.

SUMMARY OF THE INVENTION

An object of the present invention is to facilitate the operation of bringing the net device from either the "disassembled state" or the "usable state" into the other state.

Another object of the invention is to facilitate the operation of moving the net device to a desired position as by passing it through a narrow place.

The present invention provides a flying ball stopping net device for ball games, including a plurality of legs arranged side by side on the ground and respectively extending in one direction that is substantially horizontal, a frame body extending above said legs and substantially orthogonally to said one direction and along a substantially vertically extending imaginary plane, supports for supporting the lower portions of said frame body at longitudinally intermediate portions of said legs, and a flying ball stopping net closing the space surrounded with the outer edge of said frame body and attached to said frame body, said flying ball stopping net device for ball games being such that each support comprises a first support pipe projecting upward from the longitudinal intermediate portion of the leg, a second support pipe projecting downward from the lower portion of the frame body and removably fitted to said first support pipe for relative turning movement around the axis thereof, and an elastic locking body having one end fitted in one of the two support pipes and locked therein and the other end removably fitted in the other support pipe to be pressed against the inner peripheral surface thereof, and in that the inner peripheral surface of the other support pipe and the other end of said locking body pressed against said inner peripheral surface are relatively slidable around the axis of the other support pipe.

Other objects, arrangements, functions and effects than those described above will become more apparent from a detailed description of the invention to be given below with reference to the attached drawings.

BRIEF DESCRIPTION OF THE DRAWINGS

The drawings show a preferred embodiment of the invention.

DETAILED DESCRIPTION OF THE PREFERRED EMBODIMENTS

Figures 1A, 1B:
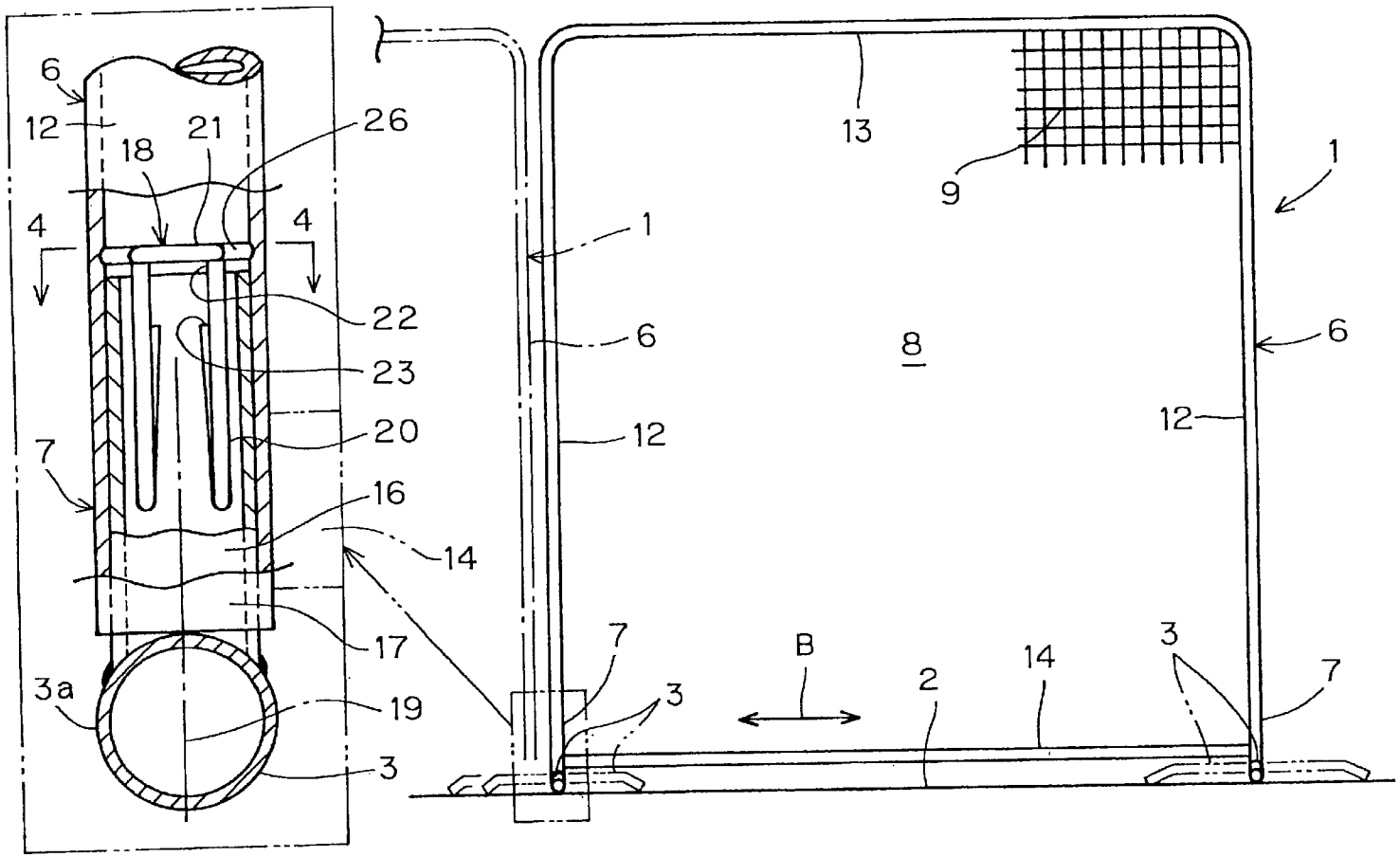
FIG. 1, consisting of FIGS. 1*a* and 1*b*, is a front view of a net device.

In the drawings, the numeral 1 denotes a flying ball stopping net device for ball games, installed on the ground 2 in the "usable state."

The net device 1 has a plurality (a pair) of legs 3 installed on the ground 2 and extending in one direction A that is substantially horizontal. These legs 3 are made of pipe circular in cross section and arranged in a substantially horizontal orthogonal direction B that is substantially orthogonal to said one direction A.

The net device 1 includes a frame body 6 extending in said orthogonal direction B above the intermediate portions 3*a* of said legs 3 that are the substantially longitudinal middle portions and along a substantially vertically extending imaginary plane 5, which frame body 6 is constructed rectangular as seen in a front view, supports 7 for supporting the right and left lower portions of said frame body 6 at the intermediate portions 3*a* of said legs 3, and a flying ball stopping net 9 entirely closing the rectangular space (8)

surrounded with the outer edge of said frame body 6 and attached to said frame body 6.

The frame body 6 comprises side pipes 12 constituting the right and left sides and substantially vertically extending, an upper pipe 13 interconnecting the upper ends of the two side pipes 12, and a lower pipe 14 interconnecting the lower ends of said two side pipes 12. These pipes 12–14 14 are circular in cross section and made of metal or resin.

Each support 7 comprises a first support pipe 16 projecting upward from the intermediate portion 3*a* of the leg 3, a second support pipe 17 integrally projecting downward from the lower portion of the side pipe 12 of the frame body 6 and removably closely fitted (externally fitted) to said first support pipe 16, and an elastic locking body 18 for removably locking said two support pipes 16 and 17 to each other. The two support pipes 16 and 17 are circular in cross section and positioned on a common axis 19, around which they are relatively turnable. Further, said two support pipes 16 and 17 are made of metal or resin.

Figure 5:
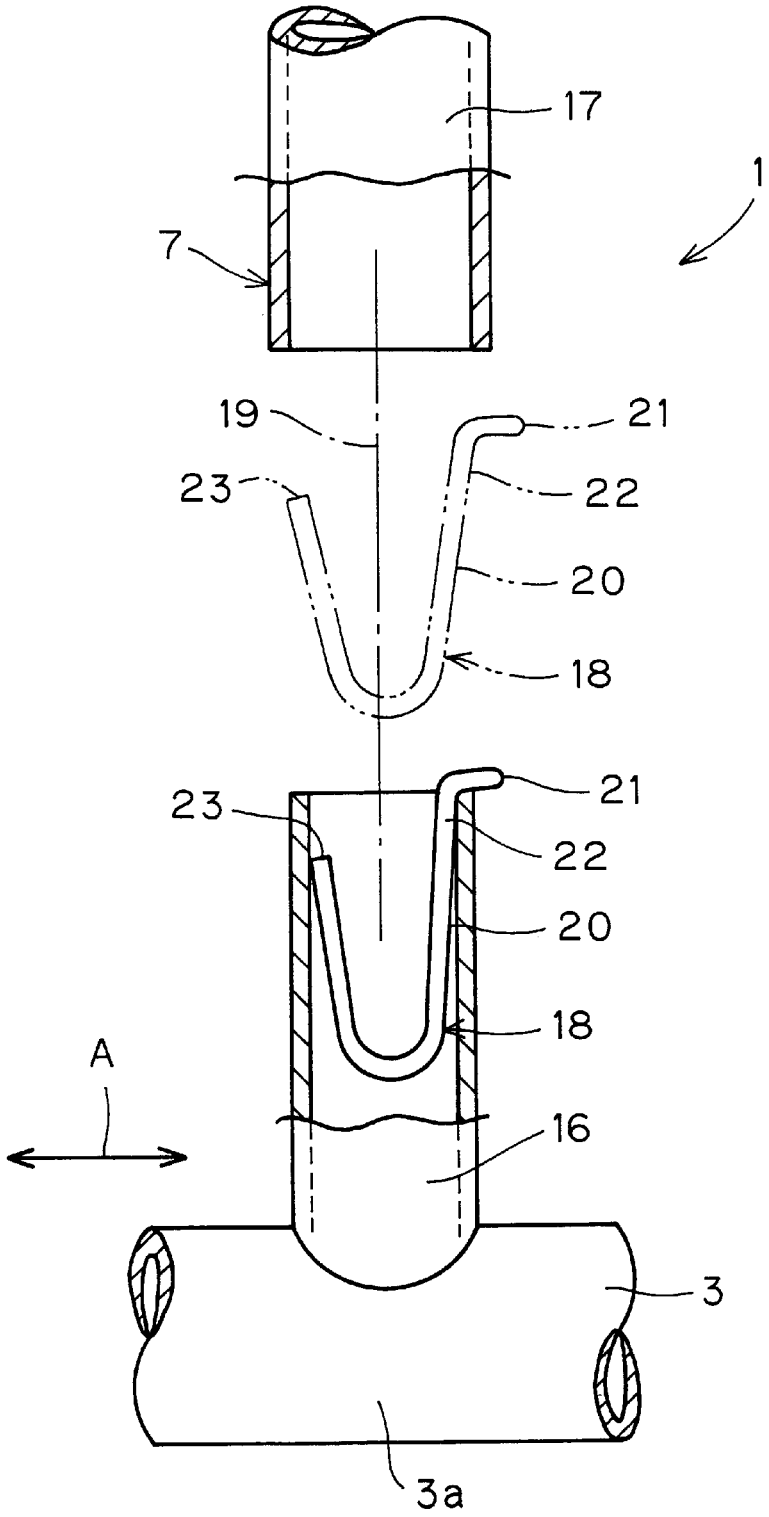
FIG. 5 is a partial developed view of what is shown in FIG. 2.

As shown in chain double-dashed lines in FIG. 5, the locking body 18 is formed by bending a single elastic wire of metal. The locking body 18 has one end 20 in the axial direction of said pipes 16 and 17 that is U-shaped and the other end 21 that integrally projects to bend through substantially 90° from a free end 22, which is one of the two free ends 22 and 23 of said one end 20.

As shown in solid lines in FIG. 5, when it is desired to lock said two support pipes 16 and 17 together by said locking body 18, this is done by elastically narrowing said one end 20 of said locking body 18 at the U-shaped width thereof and removably fitting it in the first support pipe 16, which is one of said two pipes 16 and 17. Thereupon, the corners of the free end 23, which is the other of the two free ends 22 and 23 of said one end 20, are pressed against the inner peripheral surface of said first support pipe 16 with a large frictional force, so that said one end 20 of said locking body 18 is locked by the first support pipe 16. In this case, the other end 21 of said locking body 18 is projected radially outward from the upper end of said first support pipe 16 beyond the outer peripheral surface thereof.

Figures 2A, 2B:
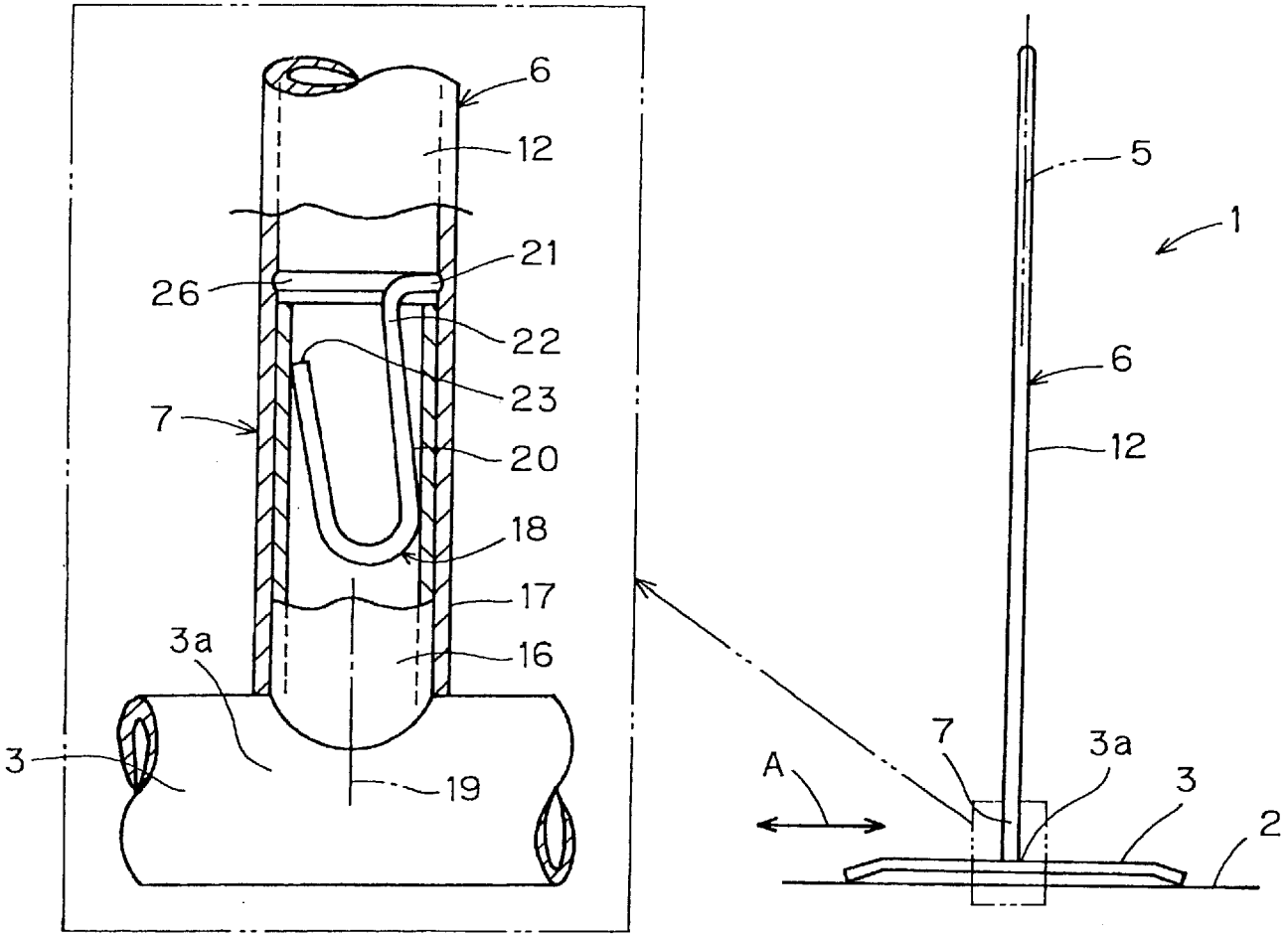
FIG. 2, consisting of FIGS. 2*a* and 2*b*, is a side view of the net device.
Figure 4:
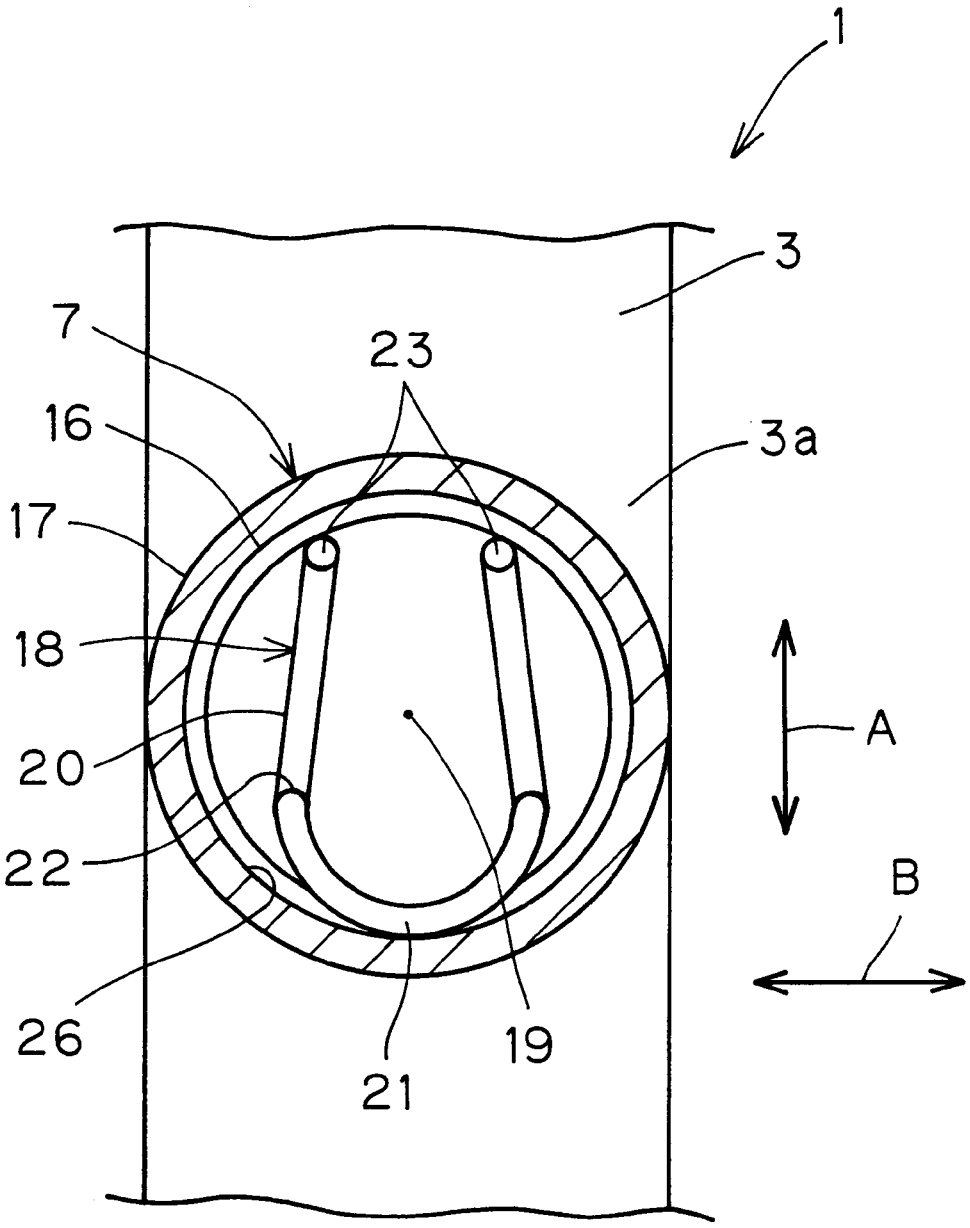
FIG. 4 is a sectional view taken along the arrow line 4—4 in FIG. 1.

In FIGS. 1, 2 and 4, the second support pipe 17, which is the other of said two support pipes 16 and 17, is fitted (externally fitted) to the first support pipe 16. Thereupon, the other end 21 of said locking body 18 is removably fitted in the second support pipe 17 and pressed against the inner peripheral surface thereof with a large frictional force. This fitting of the locking body 18 in said two support pipes 16 and 17 as described above results in the two support pipes 16 and 17 being locked together. In other words, the legs 3 and the frame body 6 are connected together and the frame body 6 is supported by said legs 3, causing the net device 1 to assume the "usable state."

On the other hand, when it is desired to bring the net device 1 into the "disassembled state," this may be done by separating the first and second support pipes 16 and 17 from each other by overcoming the frictional force acting between the second support pipe 17 and the other end 21 of the locking body 18.

According to the above arrangement, each support 7 comprises the first support pipe 16 of circular cross section projecting upward from the longitudinal intermediate portion 3*a* of the leg 3, the second support pipe 17 of circular cross section projecting downward from the lower portion of the frame body 6 to be removably fitted to the first support pipe 16 and being relatively turnable around the axis 19, and the elastic locking body 18 that has one end 20 removably fitted in the first support pipe 16 and locked therein and the other end removably fitted in the second support pipe 17 and that is pressed against the inner peripheral surface thereof.

Therefore, when it is desired to connect or disconnect the frame body 6 to or from the legs 3 in changing the net device 1 from "disassembled state" to "usable state" and vice versa, that is, when it is desired to mount or dismount the frame body 6, this can be done by fitting or separating the two support pipes 16 and 17 to or from each other and concurrently therewith simply fitting or separating one end 20 and the other end 21 of said locking body 18 to or from said two support pipes 16 and 17.

Thus, the operation of changing the net device 1 from "disassembled state" to "usable state" and vice versa does not require troublesome procedures, such as clamping or unclamping of the clamps, and said fitting or separating operation is easier than in the prior art requiring such procedures.

Figure 3:
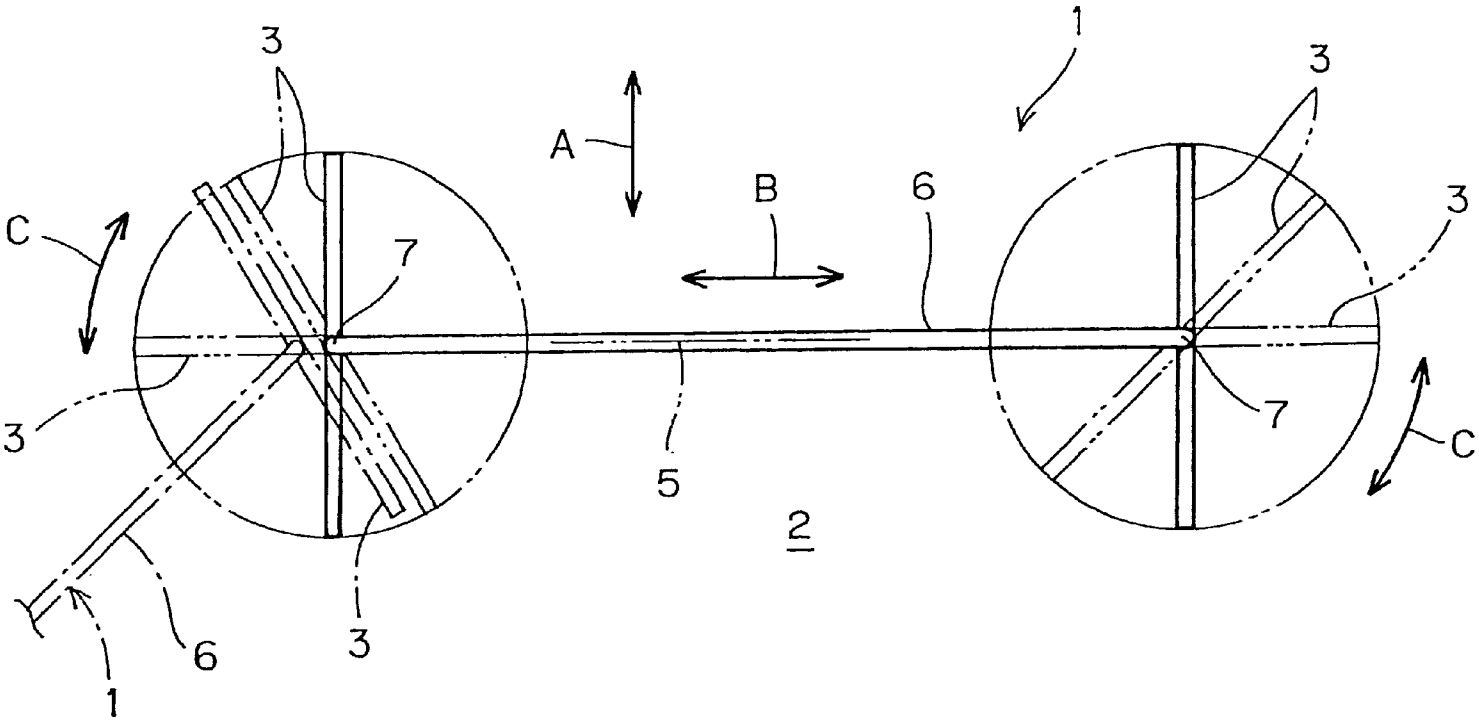
FIG. 3 is a plan view of the net device.

Further, the inner peripheral surface of said second support pipe 17 and the other end 21 of the locking body 18 pressing against said inner peripheral surface are slidable relative to each other around the axis 19 of the second support pipe 17 (arrow C in FIGS. 3 and 4).

Then, as shown in chain double-dashed lines in FIGS. 1 and 3, the two support pipes 16 and 17 are relatively turned around the axis 19 and concurrently therewith the inner peripheral surface of said second support pipe 17 and the other end 21 of the locking body 18 pressing against said inner peripheral surface are slid relative to each other around the axis 19. And the angle of the legs 3 with respect to the frame body 6 of the net device 1, as seen in a plan view, is changed.

Thereupon, while avoiding interference between the legs 3 of the net device 1 and the legs 3 of another net device 1 adjacent the first-mentioned net device 1, it is possible to bring the respective frame bodies 6 of said two net devices 1 closer to each other, and various values of the angle between the frame bodies 6 can be selected.

Further, when it is desired to move the net device 1 through a narrow place in order to store it, this is done in the same manner described above by turning each leg 3 around the axis 19 relative to the frame body 6 and aligning, as seen in a plan view, the legs 3 substantially with an extension of the frame body 6 (chain triple-dashed lines in FIG. 3).

Then, the thickness dimension of the net device 1 in said one direction A is reduced to allow the net device 1 to pass through a narrow place. And since the net device 1 is allowed to assume a flat form as a whole, a plurality of net devices 1 can be stacked in compact form for movement.

Thus, the operation involved in moving the net device 1 through a narrow place does not require troublesome procedures, such as clamping or unclamping of the clamps, and said moving operation is easier than in the prior art requiring such procedures. Further, a number of net devices 1 can be stacked and stored in a narrow space.

Further, in FIG. 4, the pressing surface of the other end 21 of the locking body 18 pressed against the inner peripheral surface of the second support pipe 17, as seen in a plan view, is an arcuate projecting surface whose radius is smaller than the inner radius of the second support pipe 17.

As a result, the sliding movement between the inner peripheral surface of the second support pipe 17 and the other end 21 of the locking body 18 is smooth owing to their low friction, and each leg 3 can be more smoothly turned relative to the frame body 6 around the axis 19 of the second support pipe 17.

Thus, the legs 3 can be smoothly adjusted to any desired angle with respect to the frame body 6, and the operation of moving the net device 1 through a narrow place, and other operations, are correspondingly facilitated.

Further, the inner peripheral surface of the second support pipe 17 is formed with a circumferentially extending annular groove 26, and the other end 21 of the locking body 18 is removably fitted in said groove 26.

As a result, axial joining of the two support pipes 16 and 17 by said locking body 18 becomes more reliable.

Thus, when the frame body 6 is raised as in moving said net device 1, the legs 3 are prevented from accidentally separating from the frame body 6, and the operation of moving the net device 1 through a narrow place is further facilitated.

In addition, while what has been described above is based on the illustrated example, the support pipe 17, which is one of the two support pipes 16 and 17, may receive one end 20 of the locking body 18 and the other, first support pipe 16 may receive the other end 21 of the locking body 18.

Further, the present invention may be embodied by suitably combining the individual components described above.

What is claimed is:

1. A flying ball stopping net device for ball games, including a plurality of legs arranged side by side on the ground and respectively extending in one direction that is substantially horizontal, a frame body extending above said legs and substantially orthogonally to said one direction and along a substantially vertically extending imaginary plane, supports for supporting the lower portions of said frame body at longitudinally intermediate portions of said legs, and a flying ball stopping net closing the space surrounded with the outer edge of said frame body and attached to said frame body, said flying ball stopping net device for ball games being characterized in that each support comprises a first support pipe projecting upward from the longitudinal intermediate portion of the leg, a second support pipe projecting downward from the lower portion of the frame body and removably fitted to said first support pipe for relative turning movement around the axis thereof, and an elastic locking body having one end fitted in one of the first and second support pipes and locked therein and the other end removably fitted in the other one of the first and second support pipes to be pressed against the inner peripheral surface thereof, and in that the inner peripheral surface of the other support pipe and the other end of the said locking body pressed against said inner peripheral surface are relatively slidable around the axis of the other support pipe, the pressing surface of the other end of said locking body pressed against the inner peripheral surface of said other support pipe, as seen in a plan view, is an arcuate surface whose surface is smaller than the inner radius of said other support pipe, and the inner peripheral surface of said other support pipe is formed with a circumferentially extending annular groove, and the other end of the locking body is resiliently biased in removable engagement with said groove.

* * * * *